US005819542A

United States Patent [19]

Christiansen et al.

[11] Patent Number: 5,819,542

[45] Date of Patent: Oct. 13, 1998

[54] HEAT EXCHANGER DEVICE

[75] Inventors: Per E. Christiansen; Bjørn Borgaas, both of Moss, Norway

[73] Assignee: Kvaerner Maritime AS, Lysaker, Norway

[21] Appl. No.: 913,235

[22] PCT Filed: Mar. 14, 1996

[86] PCT No.: PCT/NO96/00057

§ 371 Date: Sep. 10, 1997

§ 102(e) Date: Sep. 10, 1997

[87] PCT Pub. No.: WO96/28688

PCT Pub. Date: Sep. 19, 1996

[30] Foreign Application Priority Data

Mar. 16, 1995 [NO] Norway ..... 95 1011

[51] Int. Cl.[6] ..... F25B 19/00

[52] U.S. Cl. ..... 62/7; 62/50.2

[58] Field of Search ..... 62/50.2, 7

[56] References Cited

U.S. PATENT DOCUMENTS

| | | | |
|---|---|---|---|
| 2,479,070 | 8/1949 | Hansen | 62/50.2 |
| 2,943,459 | 7/1960 | Rind | 62/50.2 |
| 3,319,435 | 5/1967 | Boyd et al. | 62/50.2 |
| 3,446,029 | 5/1969 | Grgurich et al. . | |
| 3,552,134 | 1/1971 | Arenson | 62/50.2 |
| 3,720,057 | 3/1973 | Arenson . | |
| 3,726,085 | 4/1973 | Arenson . | |
| 3,726,101 | 4/1973 | Arenson . | |
| 3,827,247 | 8/1974 | Kojima et al. . | |
| 5,107,906 | 4/1992 | Swenson et al. | 62/50.2 |

FOREIGN PATENT DOCUMENTS

| | | |
|---|---|---|
| 2058644 | 3/1972 | Germany . |
| 58-84296 | 5/1983 | Japan . |
| 60-168995 | 9/1985 | Japan . |
| 62-72999 | 4/1987 | Japan . |
| 1415729 | 11/1975 | United Kingdom . |
| 4749106 | 12/1975 | United Kingdom . |
| 9417325 | 8/1994 | WIPO . |

*Primary Examiner*—Ronald C. Capossela
*Attorney, Agent, or Firm*—Birch, Stewart, Kolasch & Birch, LLP

[57] ABSTRACT

A heat exchanger device, comprising a first heat exchanger for evaporation of liquid natural gas (LNG), and a second heat exchanger for superheating of gaseous natural gas (NG). The heat exchangers (1) are arranged for heating these fluids by means of a heating medium and have an outlet which is connected to a mixing device (20) for mixing the heated fluids with the corresponding unheated fluids. According to the invention the heat exchangers (1) comprise a common housing (2), in which there are provided separate passages (7, 8) for the fluids. The mixing device (2) constitutes a unit together with the housing (2) and has a single mixing chamber (23) with one single fluid outlet (30). In separate passages (7, 8) there are provided valves (10, 26) and (13, 28) respectively for the supply of LNG or NG in the housing (1) and the mixing chamber (23).

2 Claims, 1 Drawing Sheet

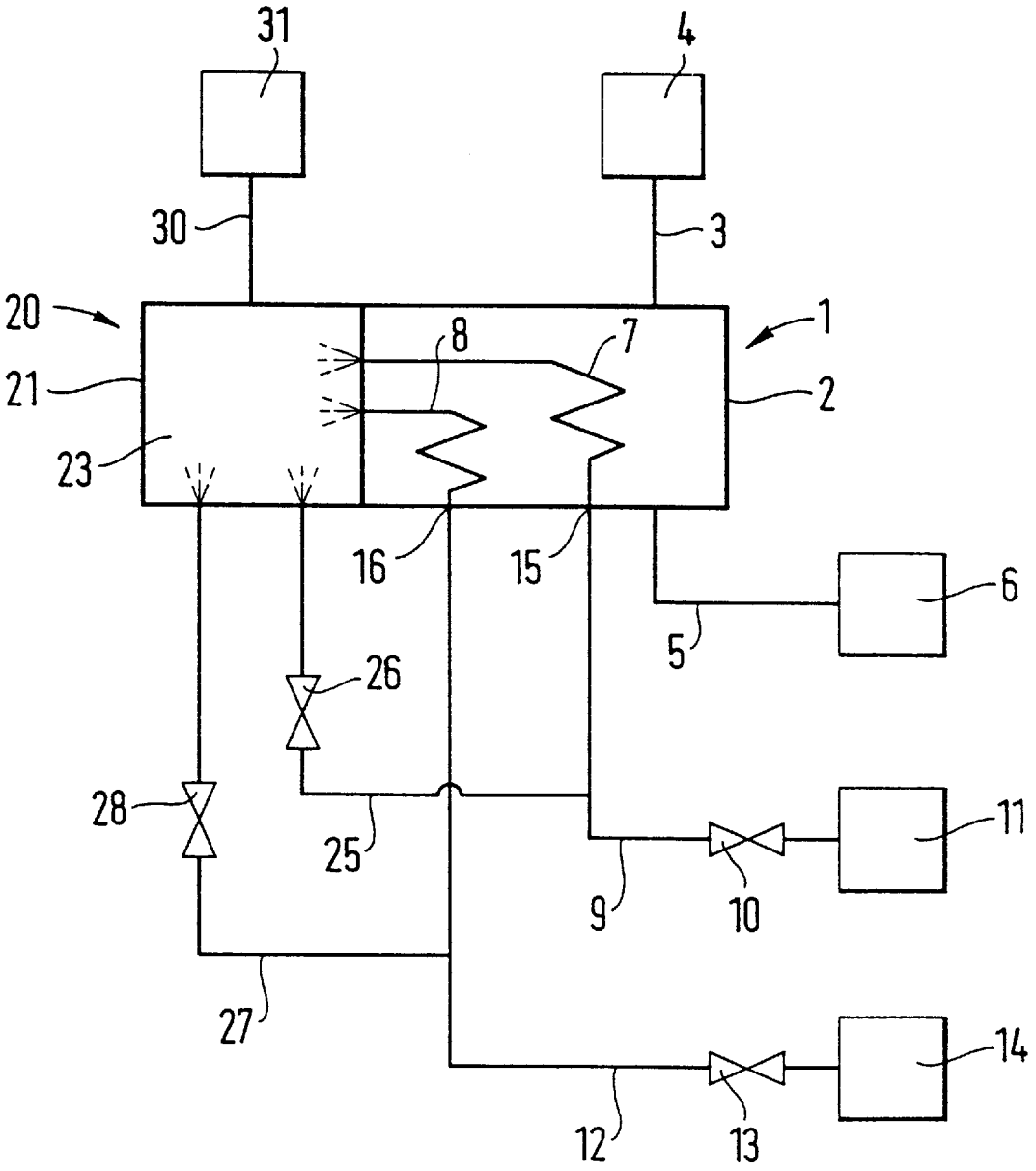
31
4
30
3
20
1
8
7
21
2
23
16
15
6
5
26
28
25
11
9
10
27
14
12
13

HEAT EXCHANGER DEVICE

The invention concerns a heat exchanger device, comprising a first heat exchanger for evaporation of liquid natural gas (LNG), and a second heat exchanger superheating of gaseous natural gas (NG) wherein the heat exchangers are arranged for heating of these fluids by means of a heating medium, which heat exchangers have an outlet which is connected to a mixing device for mixing the heated fluids with the corresponding unheated fluids.

BACKGROUND OF THE INVENTION

From the prior art, it is known that liquid natural gas, hereinafter called LNG, can be evaporated into gaseous natural gas, hereinafter called NG (see e.g. "Cryogenic commissioning of new LNG carriers", P. W. A. Eke and G. H. Gibson, LNG-5, 1977), or NG can be superheated (see e.g. "Les operations de chargement, dechargement, mise sous gas, degazage . . . ", M. Kotcharian and J. Pauthier, LNG-2, 1970), this evaporation and superheating being performed by means of separate heat exchangers. The heat exchangers can be provided on board a ship, and the medium or heating fluid whereby heat is supplied to the heat exchangers can be, e.g., steam which is supplied from a steam boiler on board the ship.

Heat exchangers of this type are used when there is a need for heating or replacement of the gas in LNG or NG tanks, e.g. on board ships, or for evaporation of LNG. This can arise if the tanks have to be subjected to inspection or maintenance, or during the manufacture of large amounts of NG by evaporation of LNG which, e.g., constitutes the cargo of the above-mentioned ship.

Furthermore, the heat exchangers are each connected via pipes, valves, etc. to their own mixing device with a mixing chamber in which heated LNG or NG can be supplied and possibly mixed with unheated LNG or NG, whereupon these fluids are supplied to a manifold, and passed to a consumers a tank or the like via a pipeline. In, e.g., the pipeline between the mixing chambers and the tank or in the manifold, there can be provided a temperature sensor which records the temperature of the fluid in the manifold and via, e.g., an electronic control device controls the opening and closing of valves for a possible supply of unheated fluid to the mixing chamber.

Thus, the known device results in an extensive pipe arrangement which requires a great deal of maintenance, since leaks can occur at flange connections, and condensation on the pipe arrangement's components as a result of the low temperature of the fluid in the pipes can cause corrosion, etc.

SUMMARY OF THE INVENTION

The object of the invention is to provide a device of the type mentioned in the introduction which is encumbered to a lesser extent by the above-mentioned disadvantages.

The characteristics of the device according to the invention are indicated by the characteristic features of the claims presented.

BRIEF DESCRIPTION OF THE DRAWING

The invention will now be described in more detail with reference to the drawing whose only FIGURE is a schematic view of a pipe arrangement which illustrates the device according to the invention.

DETAILED DESCRIPTION OF THE INVENTION

As indicated in the FIGURE, the device according to the invention comprises a single heat exchanger 1 which comprises a housing 2, which via a pipe 3 is supplied with a heating fluid, e.g. steam, from a boiler 4 on board a ship (not shown). A pipe 5 which extends from the heat exchanger carries steam therefrom to a condenser 6.

In the heat exchanger's housing 2, there are provided a first and a second pipe structure such as a coil or the like 7 and 8, respectively, through which LNG and NG respectively can flow, and which can be surrounded by the same heating fluid.

The inlet 15 of the first pipe coil 7 is connected via a first pipe 9, in which there is provided a first shut-off valve 10, with a reservoir 11 for LNG, for the supply of LNG to the pipe coil 7.

The inlet 16 of the second pipe coil 8 is connected via a second pipe 12, in which there is provided a second shut-off valve 13, with a reservoir 14 for NG, for the supply of NG to the pipe coil 8. This reservoir may have been supplied beforehand with NG from the heat exchanger during a previous evaporation of LNG in the heat exchanger 1 or in another manner.

At the outlet of the pipe coils, 7, 8 the heat exchanger's housing 2 is connected to a mixing device 20 which comprises a container 21 which contains a mixing chamber 23 which communicates with the pipe coils' outlet.

A third pipe 25 in which there is provided a third valve 26, connects the section of the first pipe 9 which is located on the downstream side of the first valve 10 with the mixing chamber 23.

Similarly a fourth pipe 27, in which there is a fourth valve 28, connects the section of the second pipe 12 which is located on the downstream side of the second valve 13 with the mixing chamber 23.

A pipeline 30 extends from the mixing chamber 23 to a consumer 31 of the heated LNG or NG.

The opening of the third and the fourth valves 26 and 28 respectively can result in mixing of unheated LNG or NG with heated LNG or NG, thereby lowering, i.e. regulating the temperature of the fluid which is supplied to the consumer 31.

By means of the invention the known device can be substantially simplified and the number of connecting pipes reduced, thus reducing the work involved in the maintenance of the device.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A heat exchanger device comprising:

a heat exchanger including a housing for receiving a heating fluid, said housing enclosing a first pipe structure, said first pipe structure having a first inlet and a first outlet, and a second pipe structure, said second pipe structure having a second inlet and a second outlet, and a mixing device connected to the housing, said mixing device including a container having a mixing chamber to which said first outlet and said second outlet communicate;

a first pipe connected to said first inlet and extending to a first reservoir for containing a first fluid, said first pipe having a first shut-off valve therein;

a second pipe connected to said second inlet and extending to a second reservoir for containing a second fluid, said second pipe having a second shut-off valve therein;

a third pipe having a third shut-off valve, said third pipe connecting a section of said first pipe located downstream of said first shut-off valve with said mixing chamber;

a fourth pipe having a fourth shut-off valve, said fourth pipe connecting a section of said second pipe located downstream of said first shut-off valve with said mixing chamber; and a pipe connected to said mixing chamber for evacuating said first and second fluids therefrom; wherein said third shut-off valve and said fourth shut-off valve are selectively operable to allow flow of at least a portion of one of said first fluid and said second fluid into said mixing chamber without passage through said housing.

2. The device of claim 1, wherein at least one of said first and second pipe structures is a coil and wherein said first fluid and said second fluid are Liquid Natural Gas and Gaseous Natural Gas, respectively.

* * * * *